US006142573A

United States Patent [19]

Harding et al.

[11] Patent Number: 6,142,573

[45] Date of Patent: Nov. 7, 2000

[54] CUSHION ELEMENT FOR USE IN A WHEELCHAIR

[75] Inventors: David Harding, Toronto; George Ward, Burlington, both of Canada

[73] Assignee: Everest & Jennings Canadian Limited, Ontario, Canada

[21] Appl. No.: 08/966,578

[22] Filed: Nov. 6, 1997

Related U.S. Application Data

[63] Continuation of application No. 08/529,459, Sep. 18, 1995, abandoned.

[51] Int. Cl.[7] ..... A47C 7/02

[52] U.S. Cl. ..... 297/452.25; 297/452.27; 5/653

[58] Field of Search ..... 297/452.25, 452.26, 297/452.27, 452.28, 284.4; 5/653, 654

[56] References Cited

U.S. PATENT DOCUMENTS

| | | |
|---|---|---|
| 2,150,287 | 3/1939 | Minor . |
| 2,552,039 | 5/1951 | Flogaus . |
| 2,825,393 | 3/1958 | Warburton et al. . |
| 3,337,884 | 8/1967 | Meier . |
| 3,376,070 | 4/1968 | Johnson . |
| 3,393,012 | 7/1968 | Chancellor, Jr. . |
| 3,503,649 | 3/1970 | Johnson . |
| 4,132,228 | 1/1979 | Green . |
| 4,522,447 | 6/1985 | Snyder et al. . |
| 4,643,481 | 2/1987 | Saloff et al. . |
| 4,682,818 | 7/1987 | Morell . |
| 4,755,411 | 7/1988 | Wing et al. . |
| 4,960,304 | 10/1990 | Frantz . |
| 5,092,655 | 3/1992 | Deegener et al. . |
| 5,114,209 | 5/1992 | Dunn . |
| 5,123,699 | 6/1992 | Warburton . |
| 5,134,740 | 8/1992 | Summer . |
| 5,317,773 | 6/1994 | Graebe . |
| 5,352,023 | 10/1994 | Jay et al. . |
| 5,378,045 | 1/1995 | Siekman et al. . |
| 5,490,299 | 2/1996 | Dinsmoor, III et al. . |

FOREIGN PATENT DOCUMENTS

| | | |
|---|---|---|
| WO 94/06327 | 3/1994 | WIPO . |

*Primary Examiner*—Anthony D. Barfield
*Attorney, Agent, or Firm*—Ostrolenk, Faber, Gerb & Soffen, LLP

[57] ABSTRACT

A cushion element for use in the wheelchair. The cushion element includes a generally rectangular body in plane having a front edge, a pair of opposed side edges and a rear edge. The cushion element is sized and shaped to be placed on a seat support of a wheelchair. The cushion element includes at least one collapsible support located toward the front edge of the element. The collapsible support is characterized by being more easily compressed towards the front edge and less easily compressed towards the rear edge. Thereby, under compression, the collapsible support forms a wedge shaped section in cross-section beneath a wheelchair occupant's legs. In this manner, the person is permitted to reach their foot down to the ground without the formation of a pressure point at the front edge of the seat cushion.

11 Claims, 2 Drawing Sheets

CUSHION ELEMENT FOR USE IN A WHEELCHAIR

This is a continuation of application Ser. No. 08/529,459 filed Sep. 18, 1995 now abandoned.

FIELD OF THE INVENTION

This invention relates to the health care field generally, and more particularly relates to ergonomic seating of the type that is appropriate for wheelchairs. Wheelchairs are often occupied by individuals who are less mobile than the average individual and thus wheelchair cushions have particular ergonomic requirements.

BACKGROUND OF THE INVENTION

Wheelchairs have been used for a long time to assist people, who are less able, to get around. Typically, the wheelchairs include a frame onto which are mounted, larger rear wheels. Two front wheels usually swivel. A handle is provided at the back to assist in pushing the wheelchair and foot rests are provided in the front for the person sitting in the wheelchair to rest their feet on. A seat and a back rest also are attached to the frame between the wheels and form the balance of the chair.

Some wheelchair occupants are so disadvantaged that they are not capable of any voluntary motion. In such cases, the wheelchairs may be provided with their own power source, such as an electric battery or the like to move the wheelchair. However, many wheelchair occupants are able to propel themselves, in their wheelchairs by hand or foot movements.

Because of the special needs of wheelchair occupants, much attention has been focused to the design of seat cushions to be used to provide the maximum comfort to the wheelchair occupants. For example, often such persons are unable to move easily, to for example, shift their weight. Constant pressure on one point can lead to the loss of circulation and the formation of sores, lesions and the like. Therefore, careful attention has been directed to the development of wheelchair seat cushions. Such seat cushions include typically a foam cushion element surrounded by a cover. The foam cushion element may be sculpted, and even formed from foams of different types, in order to provide maximum comfort.

For example, in U.S. Pat. No. 4,522,447 to Snyder, there is provided a foam seat which has a particular pattern of higher and lower density foam. Referring to FIG. 3, a horse-shoe shaped outer denser foam portion surrounds a second horse-shoe shaped inner less dense foam portion which is more easily compressed. A further denser foam area is provided in the middle of the second horse-shoe. In this manner, the cushion yields most under the regions of highest stress, namely, underneath the hip joints and thigh bones of a person sitting in the middle of the seat cushion. However, this foam arrangement is awkward to make, because it requires separate molding parameters for each of the two foam densities, and it does not solve all of the discomfort problems of wheelchair occupants.

When seated in a wheelchair, the foot rests are typically adjusted to support the part of the weight of the feet and the legs of the occupant, with the balance of the weight being supported under the thighs on the seat cushion. By raising the foot rests, more or less support is required under the thighs on the seat cushion. Ideally, the weight of the occupant should be spread evenly along the seat cushion, to avoid the formation of pressure points which could eventually lead to sores forming. Thus, the foot rests are typically made adjustable, and raised or lowered as needed to fully support the thighs of the occupant on the seat.

Many wheelchair occupants, while suffering from various infirmities, are still able to use and control one or both legs. Even if the legs are not sufficiently strong to be walked upon, there may be enough motor control and strength to propel the wheelchair occupant over short distances by a method known as foot propelling. In this method, the occupant of the wheelchair reaches down with their foot, and strikes the ground somewhat in advance of the wheelchair, and drags the wheelchair forward past their heel. Ideally, foot rests should be adjusted no lower than 2" from the ground, in order to clear uneven ground and other obstructions. For wheelchair users who use foot rests always and do not foot propel, the foot rest height is adjusted so that the front portion of the cushion bears some of the weight of the thigh. This provides for weight distribution over as great an area as possible in order to reduce sifting pressures at the rear of the cushion. For wheelchair users who foot propel, the distance from the top of the cushion to the ground must be lower in order to allow the user to reach the ground with an adequate heel strike for foot propulsion. Most foot propellers use foot rests occasionally. In these situations, foot rest adjustment is higher than what is ideal for weight distribution in order to provide adequate ground clearance.

BRIEF SUMMARY OF THE INVENTION

What is required is a wheelchair seat cushion which on the one hand provides sufficient support for the occupant along the thigh, when the occupant's feet are resting on properly height adjusted foot rests, and yet on the other hand allows the feet of the occupant to reach the ground with adequate heel strike, thus allowing effective foot propulsion. Preferably, a seat cushion capable of meeting these competing requirements is one which is easy to build, and does not involve complicated forming or molding steps. Further, the seat cushion design should not be one which compromises the comfort of the patient to achieve the objective desired.

Therefore according to the present invention there is provided a cushion element for use in a wheelchair, the cushion element comprising:

a generally rectangular body in plan having a front edge, a pair of opposed side edges and a rear edge and a thickness, and being sized and shaped to be placed on a seat support of a wheelchair, said cushion element including at least one collapsible support means located toward said front edge of said element, said collapsible support means being characterized by being more easily compressed toward said front edge and less easily compressed toward said rear edge whereby, under compression, said collapsible support means forms a wedge shaped section in side cross-section beneath a wheelchair occupant's legs, to permit a person, seated in the wheelchair to reach the ground with their feet, when their feet are not on the foot rests.

DETAILED DESCRIPTION OF THE PREFERRED EMBODIMENTS

Figure 1:
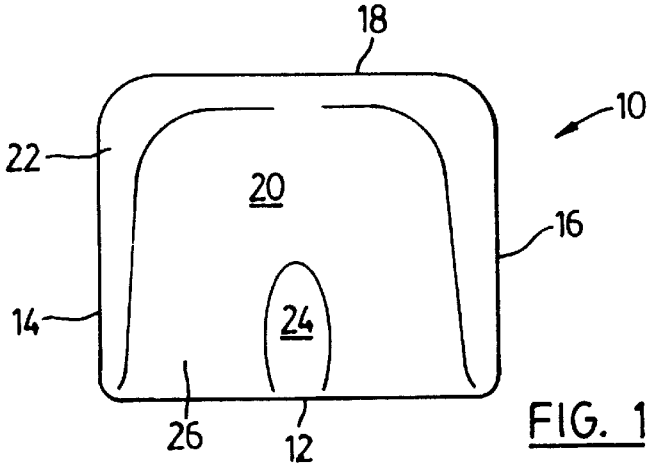
FIG. 1 is a top view of a wheelchair seat cushion according to the present invention.

FIG. 1 shows a seat cushion element generally indicated as 10 having a front edge 12, side edges 14 and 16 and a rear edge 18. The seat cushion also has a top surface 20 which may be preferably sculpted. The preferred sculpting includes a perimeter ridge 22, and a central ridge 24. The perimeter ridge may be edged, as shown, or may be rounded, to provide a smoother transition. A horse-shoe shaped depression 26 is formed between the two ridges 24 and 22 for the comfort of the person sitting on the seat. As will be appreciated by those skilled in the art, the buttocks and thighs of the wheelchair occupant are thus supported.

Figure 2:
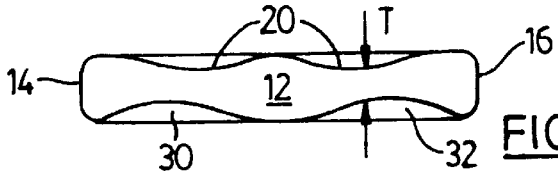
FIG. 2 is a front view of the seat cushion of FIG. 1.

FIG. 2 shows a front view of the seat cushion of FIG. 1 and includes a pair of symmetrically opposed collapsible support means 30 and 32. The collapsible support means are illustrated more fully in FIG. 3. In the embodiment shown in FIG. 2 and FIG. 3, collapsible support means 30 and 32 comprises a collapsible arched segment which extends from the front edge 12 towards the rear edge 18 on under surface 34. The curved arch provides a thinnest amount of material (shown as T in FIG. 2) towards the front edge 12.

Figure 3:
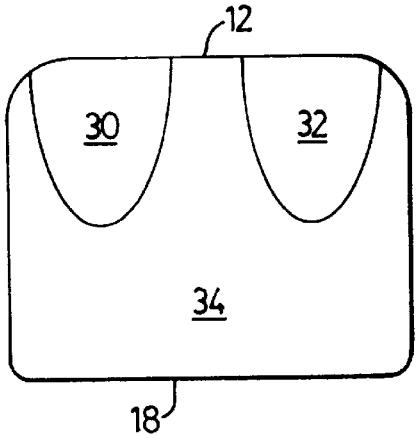
FIG. 3 is a bottom view of the seat cushion of FIGS. 1 and 2.

Good results have been achieved with the collapsible support arch extending about half way towards the rear edge as shown in FIG. 3. However, it will be appreciated by those skilled in the art that the length of the collapsible support arch from front to back across the cushion element could be varied depending on the specific needs. However, it is not likely to be necessary to extend the collapsible support arch means beyond about three quarters of the distance towards the back edge 18 from the front edge 12.

Good results have also been achieved by locating the collapsible support arches at about the mid point of each half section of the front edge of the seat cushion. Although the width of each arch can vary, the preferred width is between ¾ to ¼ of the length of the front half, with the most preferred width being about ½ of one half of the front edge (or ¼ of the total edge).

In terms of thickness of the seat cushion, ideally the seat cushion should be about as thick and most preferably slightly thicker than the height that the foot rests are above the ground as more fully explained below.

The preferred material is an open cell foam of the type commonly used in forming seat cushions. Although many foam types may be used, adequate results have been obtained with polyurethane foam. The foam may be any suitable density and resilience provided that it on the one hand collapses and on the other hand provides adequate support. The preferred foam is 3.3 $lb/ft^3$ molded high resiliency foam. The preferred firmness (measured according to Indentation Load Deflection or IDL) is of the range of 35 lbs. IDL to 50 lbs. lDL.

Figure 4:
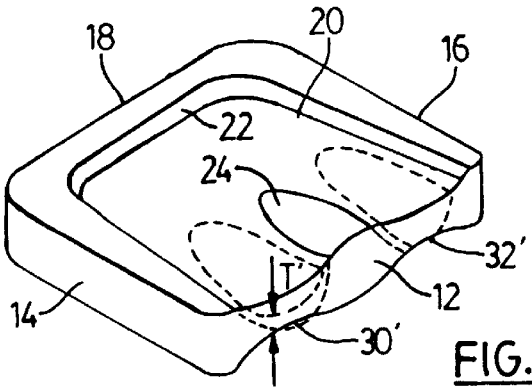
FIG. 4 is an isometric view of the seat cushion of FIG. 3.

It will be appreciated by those skilled in the art that many different configurations are possible for the collapsible support means. It has been found that the arched configuration as shown in the drawings provides good results and this may in part be due to the natural strength of an arch. The results show good support to the under side of the thigh when the feet are in the foot rest, but yet provide easy and comfortable collapsing, to allow the feet to reach the ground when the feet are taken off the foot rest. The collapsed form of the cushion element 10 is illustrated in dotted outline in FIG. 4 where the collapsed support arches are shown as 30' and 32'. It will be noted that there is still some supporting thickness (t') of cushion element at the front edge 12, which is the most preferred form of the invention. It will also be noted the form of the collapsed supporting arches 30' and 32' is of an inclined trough.

Figure 5:
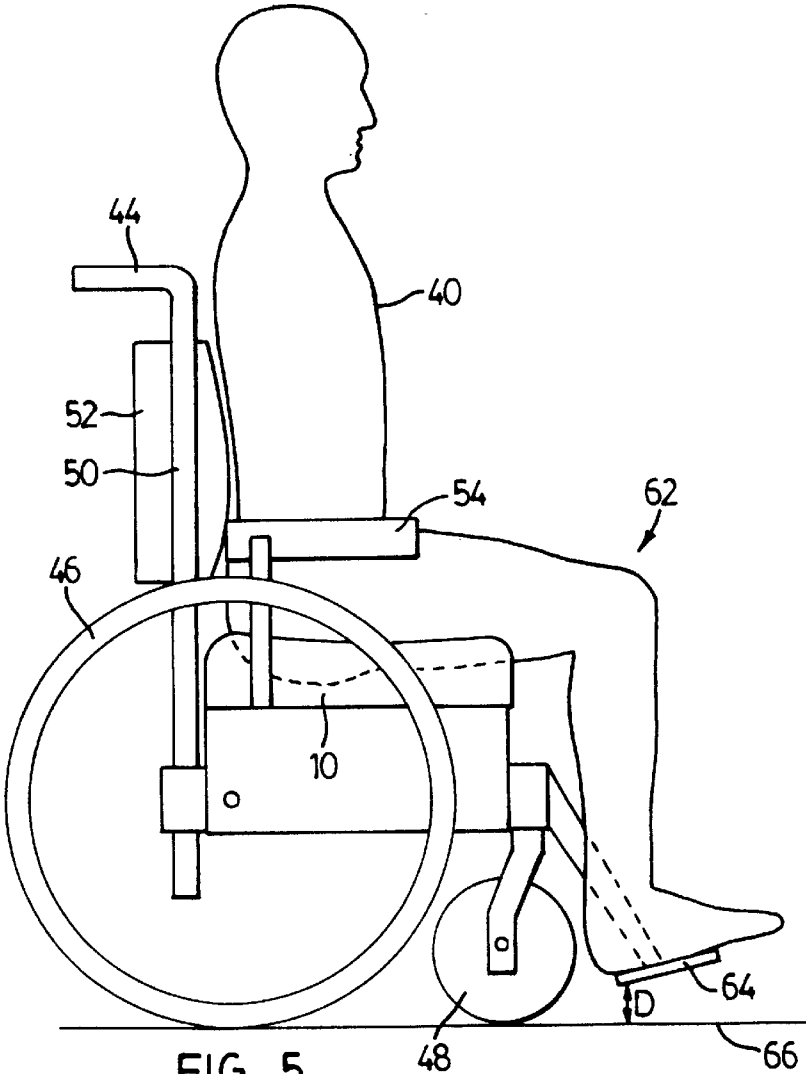
FIG. 5 is a side view of an occupant of a wheelchair with the feet in the foot rests.

Turning to FIG. 5, a person or occupant 40 supported on a cushion element 10 according to the present invention can be seen.

An occupant 40 is shown sitting on a wheelchair 42 having handles 44, large rear wheels 46, and pivoting or swivelling front wheels 48. The handles 42 are attached to a wheelchair frame 50, which include a back rest 52 and a seat cushion element 10 according to the present invention. Side armrests 54 are also provided. The occupant 50, has legs 62, which rest in foot rests 64. The lowest comfortable distanced for the foot rests 64 above the surface 66 is typically two inches. This is required to prevent the foot rests from accidentally jamming or catching on surface disconformities.

Figure 6:
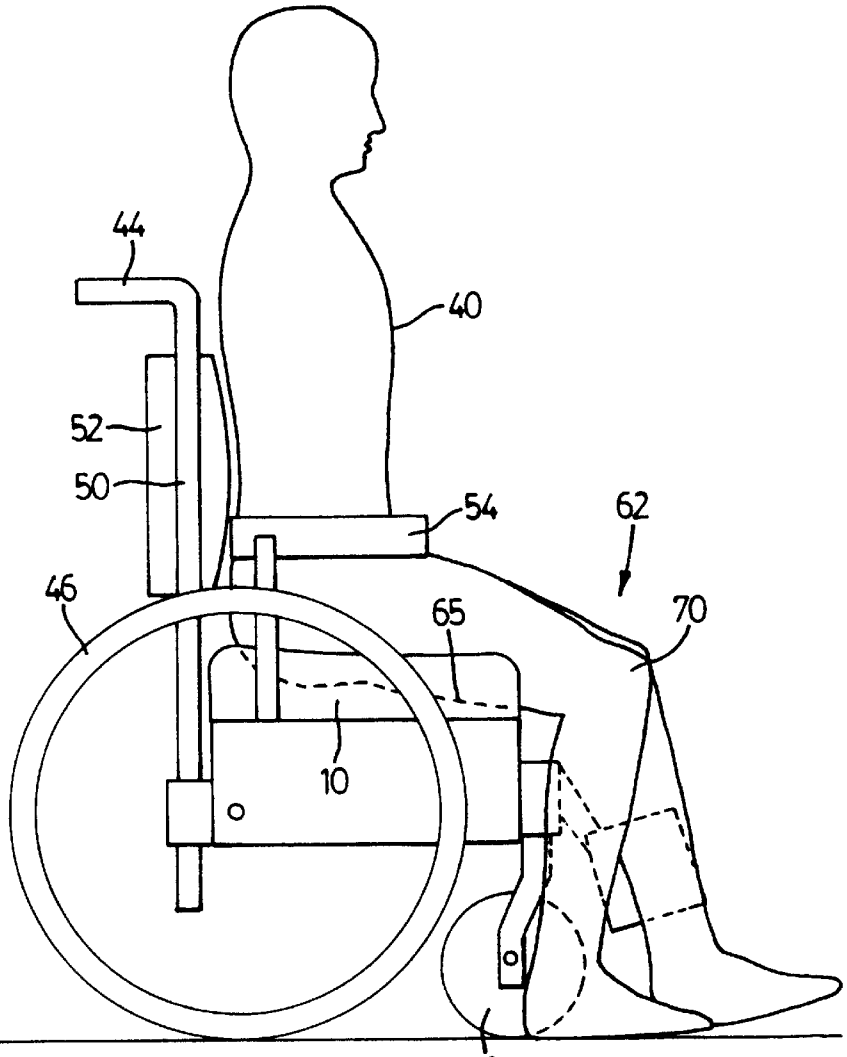
FIG. 6 is a side view of an occupant of a wheelchair with the feet lowered to the ground.

In FIG. 6, the occupant 50 is shown with the foot rests 64 in the raised position. As can be seen by the dotted line 65 underneath the legs 62 of the occupant 50, the collapsible support means 30,32 of the present invention have collapsed to form a wedged shaped supporting element underneath the occupant's legs 62. Therefore, the occupant can easily reach the ground to propel themselves by the heel strike motion technique.

Assuming that the seat cushion is about 3 inches thick, then it would be possible to collapse the front edge of the seat cushion about 2 inches, and have the heel of the occupant comfortably strike the ground. Of course, the exact amount of lowering of the foot, will depend upon the length by which the knee joint 70 extends past the front seat edge 12. The further the projection, the less compression at front edge 12 is needed. However, good results have been found with compression of the front edge of between two and three inches. It will now be appreciated that slightly more thickness is required, that the range of movement desired at the front edge, to ensure that some cushioning is still present at the very front edge 12. As this point tends to be the point of maximum stress, it is important that the front edge still have cushioning ability to soften the dynamic interaction between the underside of the thigh and the wheelchair, during a vigorous heel strike motion.

Alternate forms of the collapsible support means of the present invention, apart from arches, could include grooves cut into the foam cushion which taper towards the rear and thus provide the effect of making the foam more collapsible towards the front than towards the rear. In this embodiment there would simply be less foam under the more collapsible portion than elsewhere. Although the preferred geometry is thought to be the arches as previously described, there are other geometries which could also have the desired effect of creating an inclined trough to accommodate the underside of a person's thigh, when that person is extending their feet towards the ground and not using the footrests.

Additionally, the foam density could be varied from front to back in order the achieve the same effect without the arches, namely, to make the foam more compressible towards the front edge than towards the rear whereby the foam forms a wedge-shaped element under compression underneath the occupant's legs. Further rather than foam density, the properties of the foam material could be varied to make the foam more collapsible towards the front than towards the rear including varying the resiliency of the foam, the strength of the foam and so on. Other forms of accomplishing the desired result will be apparent to those skilled in the art. What is desired is to provide some support, when the foot rest is being used, and yet to provide a comfortable wedge shaped (in lateral cross section) or an inclined trough shaped (when viewed isometrically) supporting surface, when the feet are free from the foot rests and reaching toward the ground.

It will be appreciated by those skilled in the art that while the foregoing represents a description of the preferred embodiments of the invention, the true scope of the invention is to be considered having reference to the attached claims. Modifications and alterations are possible without departing from the broad scope of the claims, some of which have been discussed above, and others of which will be apparent to a person skilled in the art. For example, the configuration of the seat cushion could be altered to provide a number of different means whereby the seat cushion element collapses more easily towards the front than towards the rear to allow the heel of the foot strike person to more reach the ground without creating an unnecessary pressure point at or near the front edge 12.

We claim:

1. A cushion element for use in a wheelchair having foot rests and which travels over a ground surface, the cushion element comprising:

a body having a front edge, a pair of opposed side edges and a rear edge and a thickness, and being sized and shaped for placement on a seat support of a wheelchair said cushion element including two collapsible support means located toward said front edge of said cushion element and being generally symmetrically disposed about a middle of the cushion element, said collapsible support means comprising a pair of arches formed into an underside of said cushion element and extending towards the rear edge of said cushion element in an amount of between about one half a front to back length of said cushion element and about three quarters of said front to back length and being characterized by being more compressible toward a forward edge of said collapsible support means and less compressible toward a back edge of said collapsable support means whereby, under compression, said collapsible support means may be compressed sufficiently to facilitate a person seated in the wheelchair to reach the ground with their feet when their feet are not on the foot rests.

2. A cushion element as claimed in claim 1 wherein said arches have a height, the height of the arches diminishing toward said rear edge.

3. A cushion element as claimed in claim 2, wherein a thickness of said cushion element is smallest adjacent to the front edge of said element at a peak of said arch.

4. A cushion element as claimed in claim 3 wherein a smallest thickness is sized and shaped to provide cushioned support to an occupant's legs toward the front edge of the cushion element when the occupant's feet are reaching down to the ground.

5. A cushion element as claimed in claim 1 wherein said collapsible support means includes a middle and sides and wherein said collapsible support means is more collapsible towards said middle of said support means and less collapsible toward the sides of said support means to provide generally even support under a rounded underside of a human's thighs, without creating any undue pressure points.

6. A cushion element as claimed in claim 5 wherein said collapsible support means is sized and shaped to collapse in the form of an inclined trough, with a rear of a trough being higher than the front.

7. A wheelchair seat cushion comprising:

a cover; and a cushion element, the cushion element comprising:

a body having a front edge, a pair of opposed side edges and a rear edge, and being sized and shaped for placement on a seat support of a wheelchair and inside said cover, said cushion element including at least one collapsible support means located toward said front edge of said element, said collapsible support means being characterized by having an uncompressed position and a compressed position, said uncompressed position defining a pair of arches formed into an underside of said cushion element generally symmetrically about a middle of said cushion element and extending towards the rear edge of said cushion element in an amount of between about one half a front to back length of said cushion element and about three quarters of said front to back length, whereby under compression said collapsible support means may be compressed sufficiently to facilitate a person to reach the ground while sitting in a wheelchair.

8. A wheelchair comprising:

a pair of rear wheels, a pair of front wheels, a frame connecting the front and rear wheels, a backrest, a seat support connected to said frame, and a covered seat cushion element comprising a body having a front edge, a pair of opposed side edges and a rear edge, and being sized and shaped for placement on the seat support of said wheelchair, said seat cushion element including at least one collapsible support means located toward said front edge of said element, said collapsible support means being characterized by having an uncompressed position and a compressed position, said uncompressed position comprising a pair of arches formed into an underside of said cushion element generally symmetrically about a middle of said cushion element and extending towards the rear edge of said cushion element in an amount of between about one half a front to back length of said cushion element and about three quarters of said front to back length, whereby under compression said collapsible support means.

9. A cushion element as claimed in claim 8 wherein said arches extend rearwardly from said front edge toward said rear edge of said cushion element and wherein said arches have a height, the height of the arches diminishing toward the rear edge of said cushion element.

10. A cushion element as claimed in claim 9, wherein said body has a thickness, and said thickness of said body is smallest adjacent to the front edge of said element at a peak of said arch.

11. A cushion element for use in a wheelchair having foot rests, the cushion element comprising:

a body having a front edge, a pair of opposed side edges and a rear edge and a thickness, and being sized and shaped for placement on a seat support of a wheelchair, said cushion element including two collapsible support means, generally symmetrically disposed about the middle of the cushion element and being located toward said front edge of said element wherein said collapsible support means having a compressed position and an uncompressed position wherein said uncompressed position defines a pair of arches formed into an underside of said cushion element and extending towards the rear edge of said cushion element in an amount of between about one half a front to back length of said cushion element and about three quarters of said front to back length, whereby under compression said collapsible support means may be compressed sufficiently to facilitate a person to reach the ground while sitting in said wheelchair.

* * * * *